US009932789B2

(12) United States Patent
Skjaerseth et al.

(10) Patent No.: US 9,932,789 B2
(45) Date of Patent: Apr. 3, 2018

(54) FEEDING DEVICE FOR A DOWNHOLE TOOL AND METHOD FOR AXIAL FEEDING OF A DOWNHOLE TOOL

(71) Applicant: West Production Technology AS, Stavanger (NO)

(72) Inventors: Odd B. Skjaerseth, Stavanger (NO); Jarle Veshovde, Sola (NO)

(73) Assignee: West Production Technology AS, Stavanger (NO)

( * ) Notice: Subject to any disclaimer, the term of this patent is extended or adjusted under 35 U.S.C. 154(b) by 232 days.

(21) Appl. No.: 14/467,508

(22) PCT Filed: Feb. 28, 2013

(86) PCT No.: PCT/NO2013/050040
§ 371 (c)(1),
(2) Date: Aug. 25, 2014

(87) PCT Pub. No.: WO2013/129938
PCT Pub. Date: Sep. 6, 2013

(65) Prior Publication Data

US 2015/0053425 A1 Feb. 26, 2015

(30) Foreign Application Priority Data

Feb. 28, 2012 (NO) ..... 20120216

(51) Int. Cl.
*E21B 23/14* (2006.01)
*E21B 23/00* (2006.01)
*E21B 4/18* (2006.01)

(52) U.S. Cl.
CPC ..... *E21B 23/00* (2013.01); *E21B 4/18* (2013.01); *E21B 23/14* (2013.01); *E21B 2023/008* (2013.01)

(58) Field of Classification Search
CPC ..... E21B 2023/008; E21B 23/14
See application file for complete search history.

(56) References Cited

U.S. PATENT DOCUMENTS 3,890,905 A * 6/1975 Clavin ..... B21J 13/08 104/138.2
4,192,380 A * 3/1980 Smith ..... E21B 17/1021 166/104

(Continued)

FOREIGN PATENT DOCUMENTS

EP 1659259 5/2006
GB 2392687 3/2004

(Continued)

OTHER PUBLICATIONS

International Search Report and Written Opinion for PCT/NO2013/050040 dated Oct. 6, 2013.

*Primary Examiner* — Robert E Fuller
*Assistant Examiner* — Steven A MacDonald
(74) *Attorney, Agent, or Firm* — Andrus Intellectual Property Law, LLP

(57) ABSTRACT

A feeding device is for a rotatable downhole tool. The feeding device is provided with several feeding wheels lying in a plane which is slanted relative to a plane which is perpendicular to the center axis of the downhole tool. A method is for feeding a downhole tool axially by the use of the feeding device, when working a portion of a surrounding pipe body.

17 Claims, 3 Drawing Sheets

(56) References Cited

U.S. PATENT DOCUMENTS

| | | | | | |
|---|---|---|---|---|---|
| 4,558,751 | A * | 12/1985 | Huffaker | B08B 9/0553 | 15/104.05 |
| 5,348,091 | A * | 9/1994 | Tchakarov | E21B 47/01 | 166/217 |
| 5,649,603 | A | 7/1997 | Simpson et al. | | |
| 8,893,808 | B1 * | 11/2014 | Valerio | E21B 23/01 | 166/242.2 |
| 2004/0173116 | A1 | 9/2004 | Ghorbel et al. | | |
| 2011/0042072 | A1 * | 2/2011 | Villegas | E21B 17/003 | 166/250.01 |

FOREIGN PATENT DOCUMENTS

| | | | | |
|---|---|---|---|---|
| WO | WO 9521987 | A1 * | 8/1995 | E21B 4/00 |
| WO | 2010123375 | | 10/2010 | |

* cited by examiner

FEEDING DEVICE FOR A DOWNHOLE TOOL AND METHOD FOR AXIAL FEEDING OF A DOWNHOLE TOOL

CROSS-REFERENCE TO RELATED APPLICATIONS

This application is the U.S. national stage application of International Application PCT/NO2013/050040, filed Feb. 28, 2013, which international application was published on Sep. 6, 2013, as International Publication WO2013/129938 In the English language. The international application is incorporated herein by reference, in entirety. The international application claims priority to Norwegian Patent Application No. 20120216, which is incorporated herein by reference.

FIELD

A feeding device for a rotatable downhole tool is described. A method of feeding a downhole tool axially by the use of the feeding device, when working a portion of a surrounding pipe body, is described as well.

BACKGROUND

When using downhole tools that require a great degree of accuracy as regards axial feeding, for example using cutting tools when working a casing, it often presents large problems to do this work accurately enough. Axial feeding takes place, to a great extent, by a pipe string being moved forwards or being withdrawn while the tool is working, and this may easily result in the tool being overloaded so that the entire pipe string will have to be pulled up for maintenance or replacement of the tool. This involves large costs by the very fact that a pipe string of this kind may have a considerable length, especially in subsea oil and gas production and when wells with horizontal portions are used.

SUMMARY

The invention has for its object to remedy or reduce at least one of the drawbacks of the prior art or at least provide a useful alternative to the prior art.

The object is achieved through features which are specified in the description below and in the claims that follow.

A feeding device for a downhole tool has been provided, the feeding device and the downhole tool being arranged on a pipe string arranged to be inserted in a borehole in the underground. The feeding device is provided with several feeding wheels which are each radially displaceable between a retracted, inactive position and an extended, active position in which the feeding wheels bear against an internal wall surface of a body surrounding the feeding device, for example a casing. The centre axes of the feeding wheels are slanted relative to the centre axis of said surrounding body. When the feeding device is rotated around its own centre axis, the slant of the feeding wheels will make the feeding wheels follow a helical line so that the feeding device is moved in the axial direction without a push force having been applied to the pipe string. The connected downhole tool follows the axial movement of the feeding device. By the choice of a suitable slant for the feeding wheels, the downhole tool may thereby achieve a desired feed rate.

The slant of the feeding wheels may be adjustable. The adjustment may be remote-controlled. Thereby, for example, varying frictional properties of the internal wall surface of the surrounding body may be compensated for.

The axial displacement of the feeding wheels preferably takes place along an inclined plane which has its largest extent in the axial extent of the feeding device. This is advantageous because, normally, there are larger restrictions in a radial direction than in an axial direction for a downhole tool.

In a first aspect, the invention relates more specifically to a feeding device for a rotatable downhole tool, characterized by the feeding device being provided with several feeding wheels lying in a plane which is slanted relative to a plane which is perpendicular to the centre axis of the downhole tool, and the feeding wheels are displaceable between a retracted, inactive position and an active position in which they bear against an internal wall surface of a pipe body surrounding the feeding device.

A feeding-wheel suspension may be connected to a radial guide and a first actuator which, on activation, is arranged to displace the feeding wheels with a radial direction component. The radial guide may be an inclined plane. Alternatively, the radial guide may be a radial cut-out in a feeding-device housing.

The feeding device and the downhole tool may be interconnected via a transmission unit which is arranged to provide a rotational speed for the downhole tool different from the rotational speed of the feeding device.

The feeding device and the downhole tool may be arranged on a rotatable pipe string, on a non-rotatable pipe string or on a wireline.

In a second aspect, the invention relates more specifically to a method of feeding a downhole tool axially when working a portion of a surrounding pipe body, characterized by the method including the following steps:

a) the downhole tool and an associated feeding device are placed in the desired position in the pipe body;

b) several feeding wheels, which are arranged in the feeding device and lie in a plane which is slanted relative to a plane which is perpendicular to the centre axis of the downhole tool, are displaced to bear against an internal wall surface of the pipe body;

c) the downhole tool and the associated feeding device are set into a rotational motion by means of an associated driving motor;

d) the downhole tool is moved in its axial direction by the feeding wheels moving along an imaginary helical line on the internal wall surface.

The driving motor may be arranged in a remote end portion of a rotatable pipe string. Alternatively, the driving motor may be arranged in connection with a downhole end portion of a non-rotatable pipe string or a wireline.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
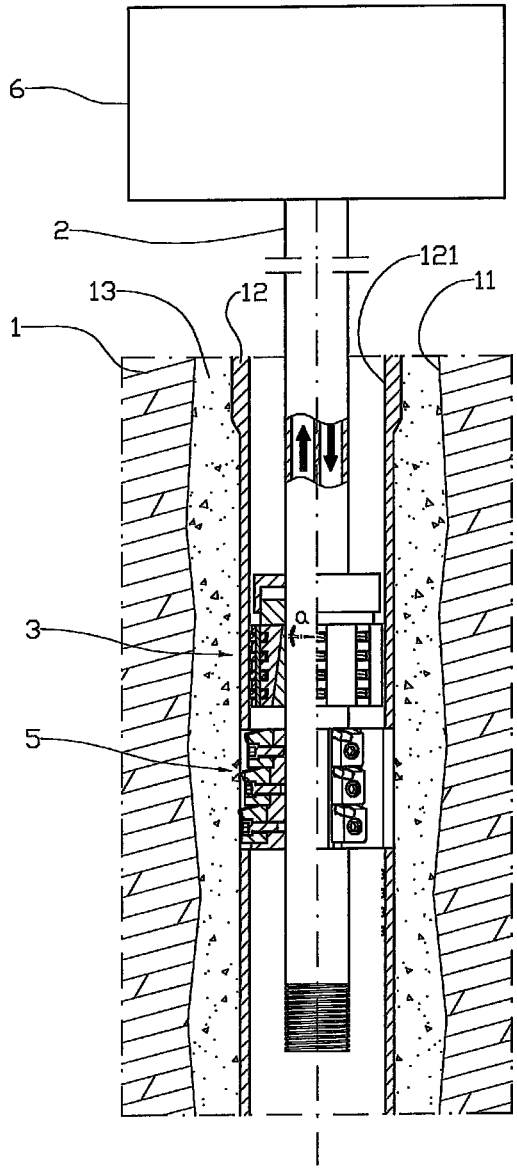
FIG. 1 shows a principle drawing of a downhole cutting tool and a feeding device according to the invention in a cut-away side view, arranged on a rotatable pipe string placed in a cased borehole.

In the figures, the reference numeral 1 indicates an underground formation in which a borehole 11 has been provided, which has been cased with a casing 12 in a manner known per se. On a pipe string 2, a feeding device 3 according to the invention is arranged in a rotationally rigid manner, and also a downhole tool 5 which is arranged, when being rotated, to work a portion of the casing 12 which, in this connection, is an example of a pipe body which, in an operative situation, surrounds at least the feeding device 3 and, with an internal wall surface 121, forms an abutment surface for feeding wheels 32 arranged in the feeding device 3. The downhole tool 5 is shown here as a cutting tool, but may be of any kind requiring axial displacement in its active state.

The space between the casing 12 and the underground formation 1 is shown as filled with cement 13 here, but this is not important for the application of the feeding device 3.

Figure 2:
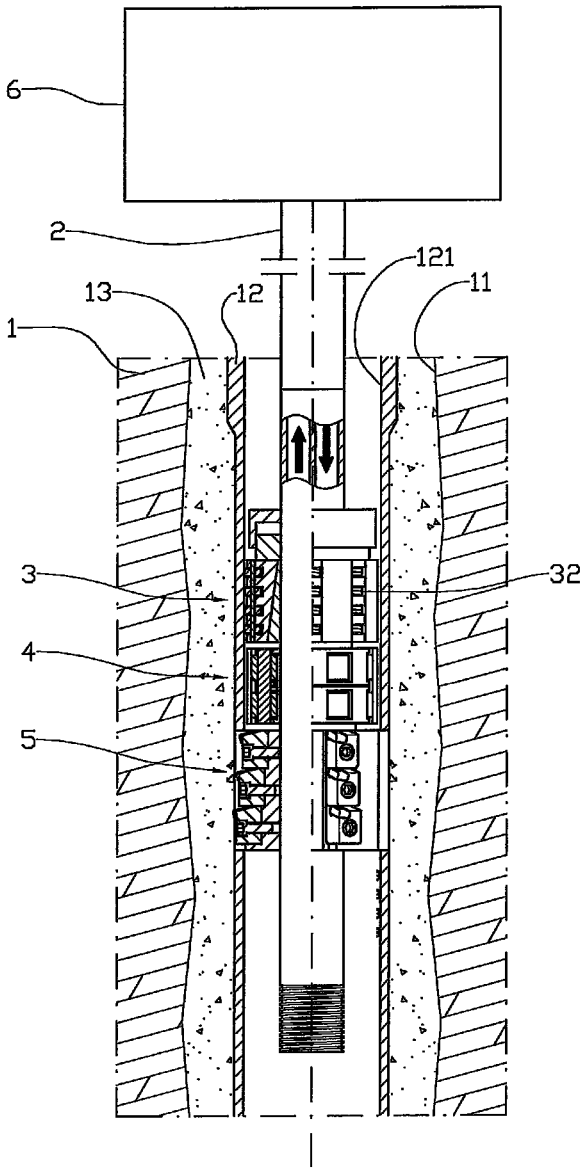
FIG. 2 shows a principle drawing corresponding to FIG. 1, but in which a transmission unit has been inserted between the downhole tool and the feeding device to provide a rotational speed for the downhole tool different from the rotational speed of the feeding device.

In addition, FIGS. 1 and 2 show a driving motor 6 connected to the pipe string 2 and arranged to rotate the pipe string 2.

In FIG. 2, an embodiment is shown in which a transmission unit 4 has been inserted between the feeding device 3 and the downhole tool 5, for example a planetary gear unit, with the aim of providing a rotational speed for the downhole tool 5 different from the rotational speed of the feeding device 3.

Figure 3A:
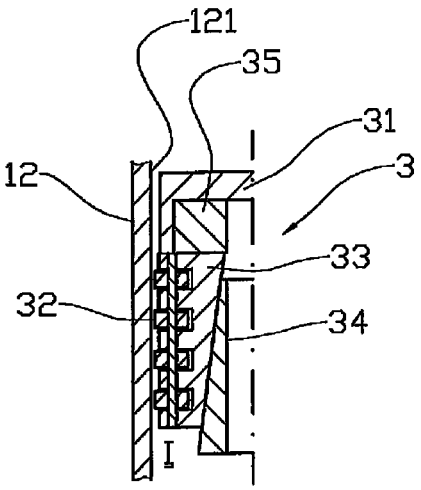
FIGS. 3*a* and 3*b* show, on a larger scale, a sectional view of an axial section of the feeding device in an inactive position I (FIG. 3*a*) and an active position II (FIG. 3*b*)
Figure 3B:
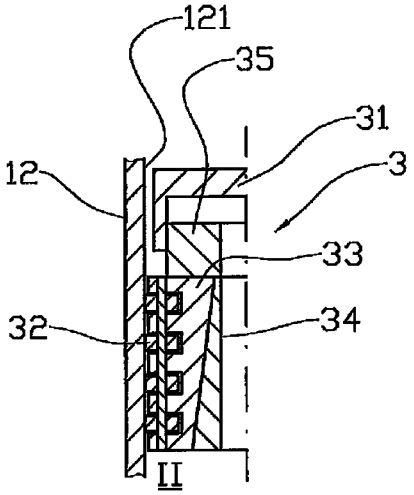

Reference is now made to the FIGS. 3*a* and 3*b*. The feeding device 3 is provided with a feeding-device housing 31 including feeding-wheel guides 34, shown here as a conical body forming an inclined plane for several wheel suspensions 33, each forming a support and attachment for several feeding wheels 32. An actuator 35 is connected to the feeding-device housing 31 and the feeding-wheel suspensions 33 in such a way that the feeding wheels 32 can be displaced between an inactive position I, in which the feeding wheels 32 have been pulled radially away from the internal wall surface 121 of the surrounding pipe body 12, in this case the casing, and an active position 11, in which the feeding wheels 32 have been pushed radially outwards into abutment against the internal wall surface 121.

The radial middle plane of the feeding wheels 32 is slanted relative to a plane which is perpendicular to the rotational axis of the feeding device 3, indicated by the angular indication a in FIG. 1. The slant results in the feeding wheels 32 moving along a helical line on the internal wall surface 121, and the slant is chosen to provide a desired, specific axial displacement, that is to say a certain axial, forward feeding per rotation of the feeding device 3. The slant of the feeding wheels 32 may be changed by replacing the feeding-wheel suspensions 33, possibly by the feeding wheels 32 being rotatably attached around a substantially radial axis (not shown) in the feeding wheel suspensions.

In the FIGS. 1 and 2 and in the preceding description, the feeding device 3 and the downhole tool 5 are shown and described in connection with a pipe string 2. The invention is not limited to such a combination, as, for example, it is conceivable for the feeding device 3, the downhole tool 5 and the driving motor 6 to be arranged as a unit which can be inserted and withdrawn in/from the casing 12 by means of a wireline 2" known per se, such a unit including means 7 for remote-operated attachment of the unit in the casing 12 for absorbing the reaction forces arising as the feeding device 3 and the downhole tool 5 are set into rotational motion by means of the driving motor 6.

Figure 4A:
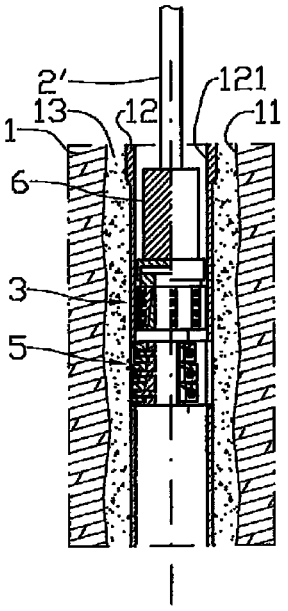
FIG. 4*a* shows, on a smaller scale, a principle drawing of the device according to the invention corresponding to that of FIG. 1 but arranged on a non-rotatable pipe string.
Figure 4B:
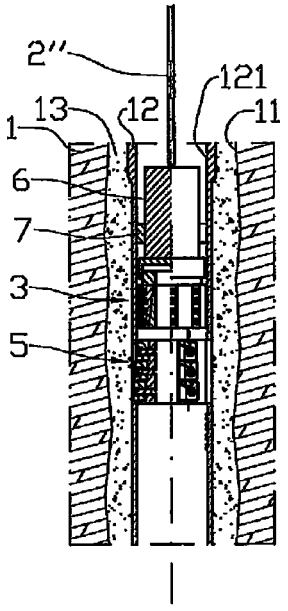
FIG. 4*b* shows, analogously to FIG. 4*a*, the device according to the invention, arranged suspended on a wireline.

A unit of a corresponding design may conceivably also be connected to a non-rotatable pipe 2', for example a coiled tubing (see FIG. 4*a*). When used together with a non-rotatable pipe 2' which is anchored to a surface installation (not shown), the feeding device 3 and the downhole tool 5, possibly together with connected elements like the transmission unit 4, be rotatably arranged on an end portion of the pipe 2, possibly without the use of the means 7 for remote-operated attachment of the unit in the casing 12, by the very fact of the reaction forces that arise when the feeding device 3 and the downhole tool 5 are set into rotating motion being absorbed by the non-rotatable pipe 2'.

It is an advantage if the feeding device 3 and the downhole tool 5, possibly together with associated elements like the transmission unit 4, are not axially fixed relative to the pipe string 2, 2', possibly the unit operated by a wireline 2", so that the axial forward feeding is not obstructed by the pipe string 2, 2', the wireline 2" or the attachment means 7.

It is obvious that the feeding device 3 may be placed in front of the downhole tool 5 or behind the downhole tool 5 (as it is shown in FIGS. 1 and 2) without this affecting the inventive concept.

The invention claimed is:

1. A feeding device for displacing a rotatable downhole tool axially while working a portion of a surrounding pipe body, wherein the feeding device is provided with several feeding wheels lying in a plane which is slanted relative to a plane which is perpendicular to a center axis of the downhole tool, and the feeding wheels are displaceable between a retracted, inactive position and an extended, active position in which the feeding wheels are configured to rotatably bear against an internal wall surface of the pipe body surrounding the feeding device, wherein the feeding wheels are further displaceable with a radial direction component and an axial direction component along an inclined plane defined between at least one pair of members configured for relative movement with each other along respective mating inclined surfaces thereof, wherein the feeding device and the downhole tool are arranged on at least one of a pipe string and a wireline, wherein an actuator displaces the feeding wheels from the retracted, inactive position to the extended, active position, wherein the feeding device has a housing connected to at least one of the pipe string and the wireline, the housing enclosing a radial guide, a feeding-wheel suspension and the actuator, wherein the feeding-wheel suspension is mounted for movable engagement against the radial guide and the actuator is connected to the feeding-wheel suspension, and is connected for axial engagement along a wall of the housing relative to an axis which is parallel to the center axis of the downhole tool, and wherein the feeding wheels are mounted for rotation in the feeding-wheel suspension with a changeable slant configured to provide a desired axial displacement and feed rate of the feeding device within the pipe body, the feeding-wheel suspension being replaceable to change the slant of the feeding wheels and thereby provide a different axial displacement and feed rate of the feeding device.

2. The feeding device in accordance with claim 1, wherein the actuator is configured, when activated, to displace the feeding wheels with the radial direction component and the axial direction component.

3. The feeding device in accordance with claim 1, wherein the radial guide has a first inclined surface defining the inclined plane, and the feeding-wheel suspension has a second inclined surface movably engaged along the first inclined surface.

4. The feeding device in accordance with claim 1, wherein the radial guide is a radial cut-out in the housing.

5. The feeding device in accordance with claim 1, wherein the feeding device and the downhole tool are interconnected via a transmission unit which is configured to provide a rotational speed for the downhole tool different from the rotational speed of the feeding device.

6. The feeding device in accordance with claim 1, wherein the feeding device and the downhole tool are arranged on a rotatable pipe string, a non-rotatable pipe string or on the wireline.

7. The feeding device in accordance with claim 1, wherein the radial guide is a conical body.

8. The feeding device in accordance with claim 1, wherein the radial guide is fixed to a pipe string extending through the pipe body.

9. The feeding device in accordance with claim 1, wherein the downhole tool and the feeding device are rotationally driven by a driving motor located outside the housing.

10. The feeding device in accordance with claim 9, wherein the driving motor is located inside the pipe string.

11. The feeding device in accordance with claim 9, wherein the driving motor includes an attachment configured to permit remote operation of the driving motor.

12. The feeding device in accordance with claim 1, wherein the at least one pair of members is configured for relative sliding movement with each other along the respective mating inclined surfaces thereof.

13. The feeding device in accordance with claim 1, wherein the feeding wheels follow a helical line along the internal wall surface of the pipe body surrounding the feeding device when the feeding wheels are in the extended, active position.

14. The feeding device in accordance with claim 1, wherein the feeding wheels when in the extended, active position cause the feeding device to move in the axial direction with zero push force applied to the at least one of the pipe string and the wireline.

15. The feeding device in accordance with claim 1, wherein when the feeding wheels are in the extended, active position, the feeding wheels and the rotatable downhole tool concurrently rotate such that the feeding wheels axially displace the rotatable downhole tool while the rotatable downhole tool is working a portion of a surrounding pipe body.

16. The feeding device in accordance with claim 15, wherein the feeding wheels move along a helical line on the internal wall surface of the pipe body surrounding the feeding device when the feeding wheels rotate in the extended, active position.

17. The feeding device in accordance with claim 1, wherein the housing completely encloses the radial guide, the feeding-wheel suspension and the actuator.

* * * * *